US006225919B1

(12) United States Patent
Lumbis et al.

(10) Patent No.: US 6,225,919 B1
(45) Date of Patent: May 1, 2001

(54) METHOD OF IDENTIFYING AND LOCATING TRAINLINE POWER SUPPLIES

(75) Inventors: Anthony W. Lumbis, Watertown; Dale R. Stevens, Adams Center, both of NY (US)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 09/412,361

(22) Filed: Oct. 5, 1999

Related U.S. Application Data

(60) Provisional application No. 60/106,830, filed on Nov. 3, 1998.

(51) Int. Cl.[7] ..... G08B 1/01; B61L 3/00

(52) U.S. Cl. ..... 340/933; 340/825.05; 340/531; 246/1 C; 246/122 R; 246/167 R; 701/19; 104/88.03

(58) Field of Search ..... 340/933, 825.05, 340/825.06, 505, 531, 539; 246/122 R, 167 R, 1 C; 701/19; 104/88.03, 88.02, 88.04, 88.05

(56) References Cited

U.S. PATENT DOCUMENTS

| | | | | |
|---|---|---|---|---|
| 5,530,328 | * | 6/1996 | Fernandez et al. | 246/187 R |
| 5,581,246 | | 12/1996 | Yarberry et al. | 340/825.38 |
| 5,581,472 | | 12/1996 | Miller et al. | 104/160 |
| 5,651,517 | * | 7/1997 | Stevens et al. | 246/167 R |
| 5,673,876 | | 10/1997 | Lumbis et al. . | |
| 5,777,547 | | 7/1998 | Waldrop | 340/438 |
| 5,907,193 | | 5/1999 | Lumbis | 307/9.1 |
| 5,966,084 | | 10/1999 | Lumbis et al. | 340/933 |
| 5,967,465 | | 10/1999 | Lumbis et al. | 340/933 |
| 5,986,577 | | 11/1999 | Bezos | 340/933 |
| 6,012,681 | | 1/2000 | Lumbis et al. | 246/187 C |

OTHER PUBLICATIONS

On–Board Train Information Network Systems, Hitachi Review vol. 43, 1994, Nos. 6, pp. 257–262.
MICAS–S2 distributed traction control for motive power units, ABB Review, 1995.

* cited by examiner

*Primary Examiner*—Donnie L. Crosland
(74) *Attorney, Agent, or Firm*—Barnes & Thornburg

(57) ABSTRACT

A method of identifying and locating the trainline power supplies wherein the power supplies each are a node on a network. The locations of the power supply is determined by causing the power supply node to transmit its identity on the network. The power supply node includes a service pin and a signal is supplied to the service pin to cause the power supply node to transmit its identity on the network. A second node is provided at an identifiable location with each power supply and is commanded to cause the power supply at its location to transmit its identity on the network.

19 Claims, 3 Drawing Sheets

METHOD OF IDENTIFYING AND LOCATING TRAINLINE POWER SUPPLIES

CROSS-REFERENCE

This application claims the benefit of U.S. Provisional Application Ser. No. 60/106,830 filed Nov. 3, 1998 which is incorporated herein by reference.

BACKGROUND AND SUMMARY OF THE INVENTION

The present invention relates generally to management of electric power supplies in a train and more specifically, to the identification and location of trainline power supplies.

With the addition of electropneumatically operated train brakes to railway freight cars comes a need to be able to automatically determine the order of the individual cars and locomotives in the train. In an EP brake system utilizing a neuron chip or other "intelligent circuitry", a wealth of information is available about the status of each car and locomotive in the train. The location of the car and locomotive as well as the trainline power supplies in the train is valuable information.

Current EP systems require a communication link between all cars and locomotives in a train or consist. The Association of American Railroads has selected as a communication architecture for EP systems, LonWorks designed by Echelon. Each car and locomotive will include a Neuron chip as a communication node in the current design. A beacon is provided in the locomotive and the last car or end of train device to provide controls and transmission from both ends of the train.

The identification and location of trainline power supplies within the train is desirable. This is needed for trainline power management, for example. It is desirable to know which power source is related to which locomotive or head end unit within that locomotive. The ability to communicate with a power source on a network related to a specific head end unit or locomotive is important if that head end unit is not active in the train. It is also necessary for certain methods of serialization, to be discussed below, to identify the power supply at an end of a train.

An automatic method of serialization includes establishing a parameter along a length of the train between a node on one of the cars and one end of the train. The presence of the parameter at each node is determined and the parameter is removed. The sequence is repeated for each node on the train. Finally, serialization of the cars are determined as a function of the number of determined presences of the parameter for each node. The parameter can be established by providing, at the individual node one at a time, an electric load across an electric line running through the length of the train. Measuring an electrical property, either current or voltage, at each node determines the presence of the parameter. The line is powered at one end at a voltage substantially lower than the voltage at which the line is powered during normal train operations. Each node counts the number of parameters determined at its node and transmits the count with a node identifier on the network for serialization.

This method is just one method of serialization and described in continued prosecution application filed Sep. 3, 1998 of Ser. No. 08/837,113 filed Apr. 14, 1997 now U.S. Pat. No. 5,966,084 which is a continuation-in-part of U.S. patent application Ser. No. 08/713,347 filed Sep. 13, 1996 now abandoned, which are incorporated herein by reference.

In order to properly execute the serialization feature, it is necessary to determine which trainline power source is located at one end of the train prior to initiating the train serialization sequence. This is particularly a problem where more than one locomotive or trainline power supply is available in the train. If one of the trainline power supplies that are not at an end of the train is activated during the power sequence, the serialization sequence would be inaccurate in that not all of the cars would be connected between the power supply and the other end of the train. For example, if the power supply was in the center of train, and the cars were sequentially activated to apply a load and count, you would have duplicate counts on each side of the center power source. Thus, it is important to the serialization process that the trainline power supply at one end of the train, be it the leading end or trailing end, is the only source actuated during the serialization sequence.

The present invention is a method of identifying and locating the trainline power supplies on a train wherein the power supplies each are a node on a network. The method includes determining the identity of a power supply at one end of the train and determining the identity of the other power supplies sequentially. The end power supply is determined by causing the power supply node at the end to transmit its identity on the network. The power supply node includes a service pin and a signal is supplied to the service pin to cause the power supply node to transmit its identity on the network. The location and identity of the other power supplies may be determined by causing power supply nodes at an identifiable location to transmit its identity on the network. A second node is provided at the identifiable location with each power supply. The second node is commanded to cause the power supply at its location to transmit its identity on the network. As with the end power supply, the power supply nodes each includes a service pin and a signal is supplied to the service pin by the second node to cause the power supply node to transmit its identity on the network. The identifiable location of the other power supplies is determined by serializing the second nodes.

A method of identifying and locating power supplies on a trainline includes providing power supplies at each as a node on the communication network and providing a second node on the network at an identifiable location with each power supply. The second nodes are commanded to cause the power supply node at its location to transmit its identity on the network. The power supply nodes include a service pin and signals are applied to the service pin by the second node to cause the power supply node to transmit its identity on the network. The location of the power supply is determined by serializing the second nodes.

A train, according to the present invention, has a trainline extending between one or more locomotives and cars in the train. The train includes a plurality of power supplies each connected as a node on a communication network. At least one second node is provided on the network at one end of the train. Each power supply node includes a service pin and transmits its identity on the network in response to a signal on the service pin. The second node is connected to the service pin of a power supply at the end of the train and provides a signal to cause the power supply node at its location to transmit its identity on the network. In one embodiment, a second node is provided on the network at each power node and is connected to the service pin of the power supply and provides the signals to cause the power supply at its location to transmit its identity on the network. The power supply and the second nodes are on a common locomotive. Further, each second node includes hardware and software for locating the node in the train. Alternatively, the power supply may not be associated with a second node and includes its own hardware and software for locating the node on the train. The location of the second node or the power supply uses a serialization process.

Other advantages and novel features of the present invention will become apparent from the following detailed description of the invention when considered in conjunction with the accompanying drawings.

DETAILED DESCRIPTION OF THE PREFERRED EMBODIMENTS

Figure 1:
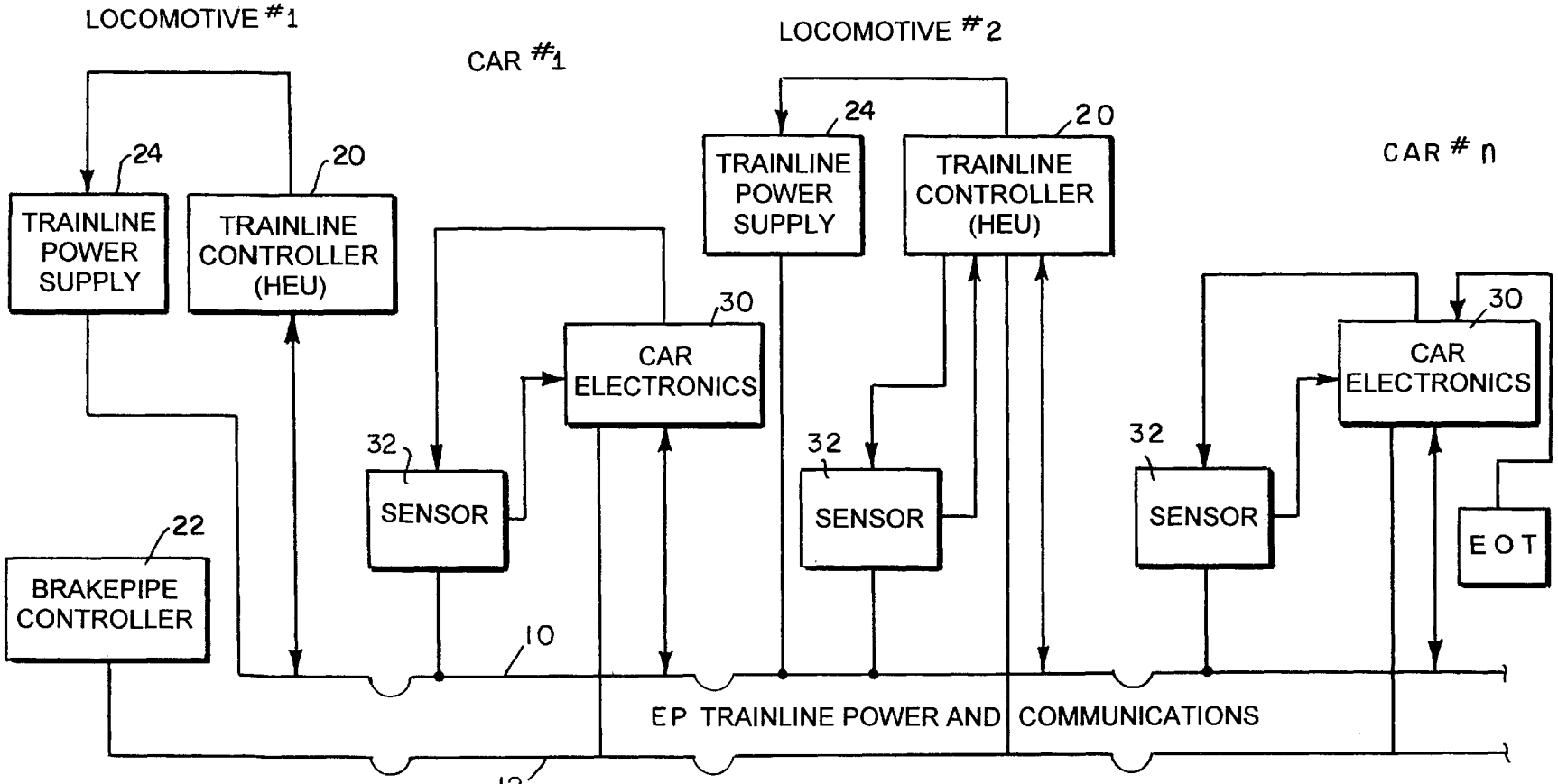
FIG. 1 is a block diagram of a train incorporating electropneumatic brakes and a communication system incorporating the principles of the present invention.

A train consisting of one or more locomotives and a plurality of cars is shown in FIG. 1. An electropneumatic trainline 10 transmits power and communication to the individual nodes on the cars. A brake pipe 12 provides pneumatic pressure to each of the cars to charge the reservoirs thereon. The locomotives include a trainline controller 20 or head end unit (HEU) which provides the power and the communication and control signals over the EP trainline 10. A brake pipe controller 22 controls the pressure in the brake pipe 12. A power supply 24 receives power from the locomotive low voltage supply and provides the required power for the EP trainline 10.

Figure 2:
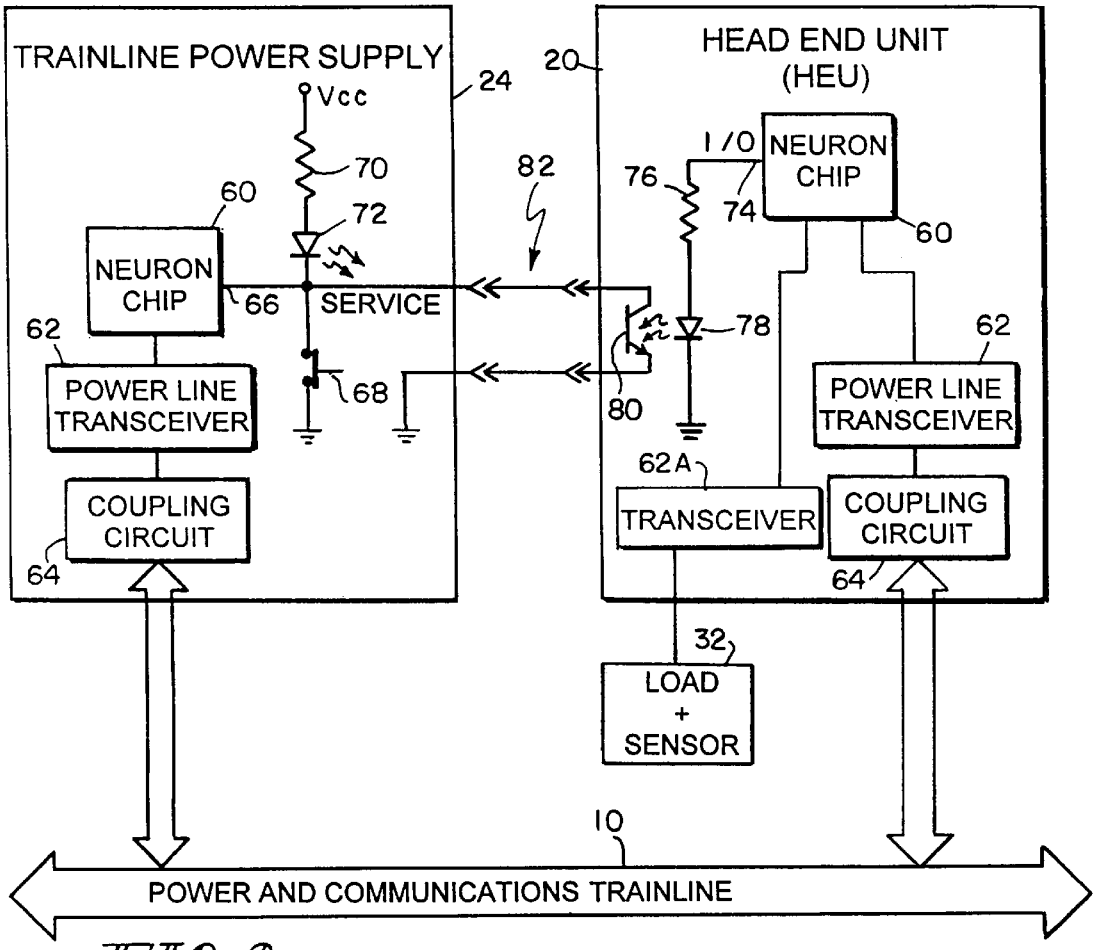
FIG. 2 is a block diagram of the electronics in the individual locomotives of the train with position sensor in the head end unit incorporating the principles of the present invention.
Figure 3:
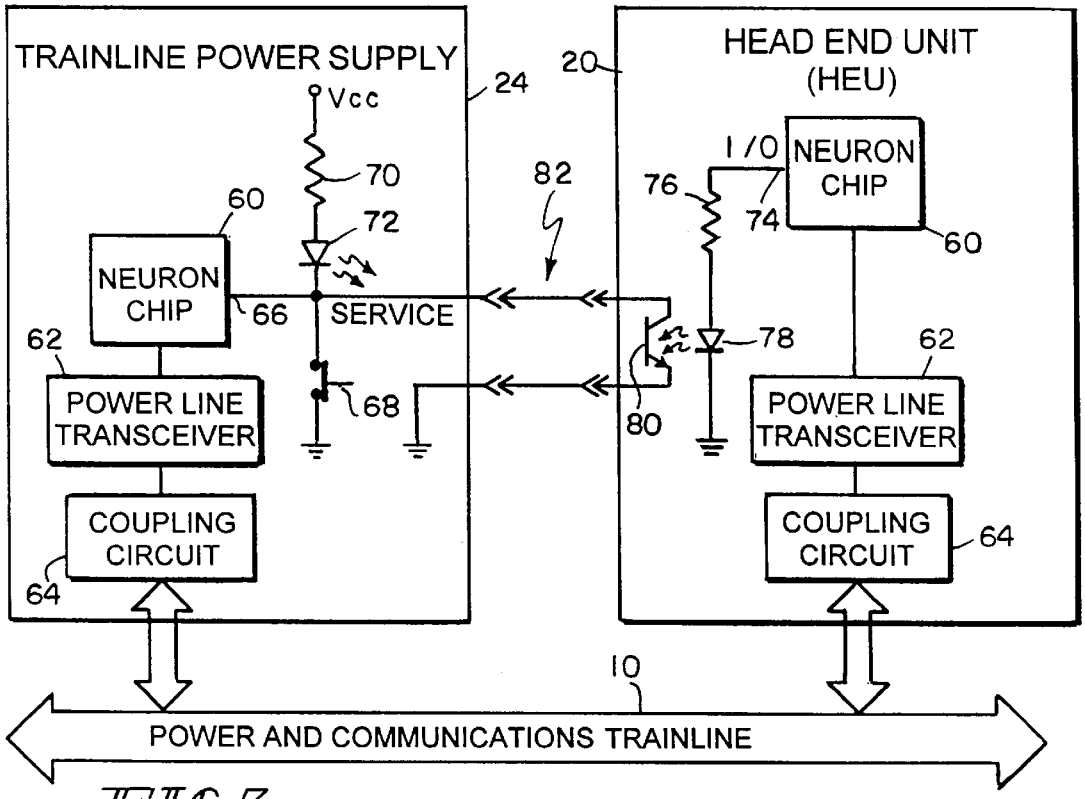
FIG. 3 is a block diagram of the electronics in the individual locomotives of the train with no position sensor incorporating the principles of the present invention.
Figure 4:
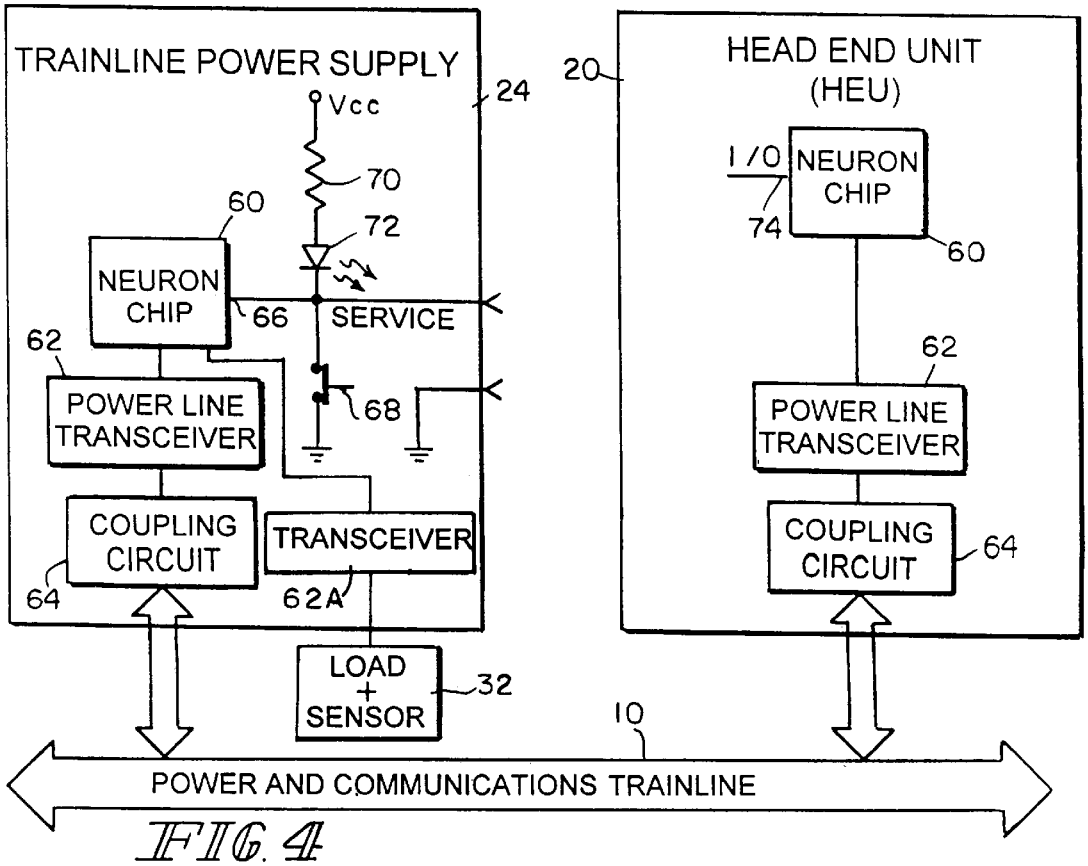
FIG. 4 is a block diagram of the electronics in the individual locomotives of the train with position sensor in the trainline power supply node incorporating the principles of the present invention.

Two locomotives are illustrated as distributed throughout the train to illustrate the present invention. Additional locomotives may be in the train at various locations and all the locomotives may be at a single location. In the illustrated example, locomotive 1 is the lead locomotive and is at an end of the train. The other locomotives may include a sensor and corresponding hardware and software to have its position determined during a serialization process. As illustrated, locomotive 2 has a sensor for serialization. The lead locomotive 1 may also be equipped with a sensor as shown in FIG. 2. Alternatively, the locomotives may not have position determining hardware or software as illustrated in FIG. 3 or a power supply node may have the position determining hardware and software as illustrated in FIG. 4, in which case, the head end unit 20 may, but need not be a node on the network.

Each of the cars include car electronics 30 which are capable of operating the electropneumatic brakes as well as providing the necessary communications. The trainline controllers 20, power supplies 24 and the car electronics 30 are preferably LonWorks nodes in a communication network although other systems and regimens may be used. Car electronics 30 will also provide the necessary monitoring and control functions at the individual cars. With respect to a serialization method, a sensor 32 may be connected to the trainline controllers 20, power supplies 24 and car electronics 30, to sense the current or voltage of the trainline 10 at each node or car. Preferably, the sensor 32 is a current sensor and may be a Hall effect sensor or any other magnetic field sensor which provides a signal responsive to the current in the trainline 10. Alternatively, the sensor 32 may be a voltage sensor. The trainline controllers 20, power supplies 24 and car electronics 30 measures a parameter at its node or car and transmits the results along the trainline 10 to a lead trainline controller 20. If the trainline controllers 20 and power supplies 24 do not include the appropriate hardware and software, they do not participate in the serialization process.

The brake pipe 12 is also connected to the car electronics 30 of each car as well as the air brake equipment (not shown). The car electronics 30 monitors the brake pipe 12 and controls the car's brake equipment as a back up to the signals received on the trainline 10. The trainline's power and communication is either over common power lines or over power and separate communication lines. The individual communication nodes are also powered from a common power line even though they may include local storage battery sources.

The locomotives' trainline controllers 20 and the power supplies 24 also include electronics to function as a node on the network.

The trainline controllers 20 at one end of the train, locomotive 1 in the example of FIG. 1, powers up the trainline 10. Once the trainline 10 is powered, the HEU requests that each of the car and/or trainline controllers 20 and power supplies 24 which have serialization capability to activate the current sensor 32 and associated serialization electronics.

The serialization process will individually and sequentially ask each node, car, locomotive or trainline power source to activate its load resistor and request the other nodes to determine if trainline current is present. Those nodes between the car control device which has applied its load and the head-end unit will detect current. Those nodes between the car control device which has the activated load and the end of train will not detect a current. Alternatively, the power supply may be at the end of train device EOT and the presence of current will be from the applied load to the end of the train. At the end of the sequence or after each iteration, the count in each node is reported to the head-end unit which then can perform serialization at the end of the sequence.

As can be seen from FIG. 1, if the second locomotive 2 was the trainline power supply for the serialization sequence, the counts within the serialization sequence would substantially increase the difficulty of performing serialization. Since locomotive 2 is in the middle of the train, cars between locomotive 1 and locomotive 2 would have duplicate counts with cars between locomotive 2 and the end-of-train device, EOT. Thus, before serialization can be conducted, the location of a trainline power supply at one end of the train must be determined.

Those elements of the trainline power supply 24 and the trainline controller 20 related to providing communication nodes on the network are illustrated in FIGS. 3 and 4. Each node includes a Neuron chip 60 connected to a power line transceiver 62 and coupled to the trainline 10 by coupling circuit 64. The Neuron chip 60 may be part number 3150 and the transceiver may be a PLT10A. The coupling circuit 64 is well known. All Neuron chips 60 include a pin 66, known as a service pin, which when grounded, causes the Neuron 60 to transmit its unique Neuron chip I.D. number. A manual switch 68 is connected between ground and the service pin 66 to cause the Neuron to transmit its I.D. A resistor 70 and a light emitting diode 72 are connected between the voltage source VCC and the service pin 66. Thus, when switch 68 is closed, the light emitting diode 72 will illuminate indicating that the Neuron chip 60 is transmitting its I.D. number.

One method for determining the trainline power supply 24 at one end of the train, for example, locomotive 1 in the example of FIG. 1, is to have the engineer manually closed switch 68. The Neuron chip 60 would then transmit its I.D. to the head end unit such that the head end unit 20 of the lead locomotive will only actuate that trainline power supply during the serialization sequence. Although this is one method contemplated by the present invention, an automatic method is desirable so as to avoid any mistake or skipping of the step by the engineer during power up and serialization.

To achieve this end, the head end unit 20 of at least the lead locomotive or the locomotive at one end of the trainline includes at an I/O port 74, a resistor 76 and a light emitting diode 78. The light emitting diode 78 is part of an electro-optical isolator which includes light sensor transistor 80. The transistor 80 is connected by lines 82 to the service pin 66 and ground at the trainline power supply 24. Prior to initiating the serialization, the Neuron chip 60 of the lead locomotive provides a signal on I/O port 74 which grounds the service pin 66 of its trainline power supply causing it to transmit its I.D. number on the network. Now that the head end unit 20 of the lead locomotive has identified its power supply, it can communicate on the network so as to only actuate that power supply during the serialization sequence.

Each of the other locomotives throughout the train may also include head end unit 20 and the power supply 24 as two nodes on the network. After the lead locomotive has identified its power supply, it would command sequentially each of the head end units 20 to send a signal to the service pin 66 of its trainline power supply such that the trainline power supply 24 can transmit its I.D. number. This will allow the lead trainline controller 20 to identify a particular power supply with a particular head end unit 20. The head end unit 20 and the trainline power supply 24 are two nodes which are on a single locomotive within the train.

If the locomotive or head end unit 20 includes a load and sensor 32 and the appropriate load, software and hardware to participate in the serialization sequence as in FIG. 2, the location of the power supply in the train can also be determined by determining the location of the trainline controller 20. A transceiver 62A connects the Neuron Chip 60 to the load and sensor 32. In the embodiment illustrated in FIG. 3, no sensor 32 or load is provided such that the position of the locomotive in the trainline cannot be determined. The only information which is determined is that a particular power supply node on the network is associated with a particular head end unit or second node.

As a further alternative as illustrated in FIG. 4, the load and sensor 32 may be provided at the trainline power supply node 24 such that the trainline power supply node 24 can participate in the serialization process. Transceiver 62A connects the load and sensor 32 to Neuron Chip 60. Thus, this locomotive or the car in which the trainline power supply 24 is provided may not include a trainline controller 20 or head end unit. Even if a train controller 20 is provided and does not include circuitry to drive the service pin 66 or is not active, the power supply operates as a node capable of participating in the serialization process. The communication node for the trainline power supply 24 would operate as the car electronics 30 for a car versus in combination with a head end unit or trainline controller 20 as illustrated in FIGS. 1, 2 and 3.

The embodiment of FIG. 3 is to be used where connection to or existence of a head end unit 20 is not available. The embodiments of locating the power supply 24 of FIGS. 2 and 3 are preferred where connection to a head end unit is available.

It should also be noted that the power line transceiver 62 may be shared between the trainline power supply 24 and the head end unit 20, or the Neuron chip 60 of the trainline power supply may have its transceiver communicate with the Neuron chip 60 of the head end unit 20, which then communicates with the trainline 10.

As previously discussed, the ability to locate the trainline power supply node at an end of a train is very important to performing serialization sequence. Being an active node, the identification of the other trainline power supplies on the network can be identified using any standard polling technique. The location of the other trainline power supplies within the train can be performed by either having the trainline power supply include the hardware and software which is capable of participating in the serialization process or being associated with a head-end unit or trainline controller 20 which has the hardware or software capable of participating in the trainline serialization sequence.

By knowing the location of the trainline power supplies in the train or the locomotive they are associated with, they can be selectively energized. The selective energization of the power supplies will minimize the demand on the lead locomotive power supply. By sharing power between the non-lead locomotives, each trainline power supply will have a reduced requirement.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A method of identifying and locating trainline power supplies on a train wherein the power supplies each are a node on a communication network comprising:

determining the identity of a trainline power supply at one end of the train; and determining the identity of the other trainline power supplies sequentially.

2. A method according to claim 1, wherein the end trainline power supply is determined by causing the power supply node at the end to transmit its identity on the network.

3. A method according to claim 2, wherein the power supply node includes a service pin and a signal is applied to the service pin to cause the power supply node to transmit its identity on the network.

4. A method according to claim 1, wherein the location and identity of the other trainline power supplies is determined by causing power supply node at an identifiable location to transmit its identity on the network.

5. A method according to claim 4, including a second node at an identifiable location with each trainline power supply; and the second node is commanded to cause the power supply node at its location to transmit its identity on the network.

6. A method according to claim 5, wherein the power supply node includes a service pin and a signal is applied to the service pin by the second node to cause the power supply node to transmit its identity on the network.

7. A method according to claim 5, wherein the identifiable location of the other trainline power supplies is determined by serializing the second nodes.

8. A method according to claim 4, wherein the power supply node includes a service pin and a signal is applied to the service pin to cause the power supply node to transmit its identity on the network.

9. A method according to claim 1, including a second node at an identifiable location with each trainline power supply; and the second node is commanded to cause the power supply node at its location to transmit its identity on the network.

10. A method according to claim 9, wherein the power supply node includes a service pin and a signal is applied to the service pin by the second node to cause the power supply node to transmit its identity on the network.

11. A method according to claim 9, wherein the identifiable location of the other trainline power supplies is determined by serializing the second nodes.

12. A method of identifying and locating trainline power supplies on a train comprising:

providing trainline power supplies each as a node on a communication network;

providing a second node on the network at an identifiable location with each trainline power supply;

commanding the second node to cause the power supply node at its location to transmit its identity on the network; and locating the trainline power supplies by locating the second nodes.

13. A method according to claim 12, wherein the power supply node includes a service pin and a signal is applied to the service pin by the second node to cause the power supply node to transmit its identity on the network.

14. A method according to claim 12, wherein the location of the trainline power supplies is determined by serializing the second nodes.

15. A train having a trainline extending between one or more locomotives and cars in the train, the train including:

a plurality of trainline power supplies on a train each connected as a node on a communication network;

at least one second node on the network at one end of the trainline;

each power supply node including a service pin and transmit its identity on the network in response to a signal on the service pin; and the second node being connected to the service pin of a trainline power supply at the end of the trainline and providing a signal to cause the power supply node at its location to transmit its identity on the network.

16. A train according to claim 15, including a second node on the network at each power supply node connected to the service pin of a trainline power supply and providing a signal to cause the power supply node at its location to transmit its identity on the network.

17. A train according to claim 16, wherein the trainline power supplies and the second nodes are on a common locomotive.

18. A train according to claim 16, wherein each second node includes means for locating the node in the train.

19. A train according to claim 15, wherein each power supply node includes means for locating the node in the train.

* * * * *